US006086063A

United States Patent [19]

Esenther

[11] Patent Number: 6,086,063

[45] Date of Patent: Jul. 11, 2000

[54] SHEET STACKING APPARATUS

[76] Inventor: Paul Esenther, 1257 Dunamon Dr., Bartlett, Ill. 60103

[21] Appl. No.: 09/052,542

[22] Filed: Mar. 31, 1998

[51] Int. Cl.[7] ..... B65H 29/32

[52] U.S. Cl. ..... 271/194; 271/197; 271/188; 414/793; 414/793.1

[58] Field of Search ..... 271/188, 194, 271/195, 196, 197; 414/793, 793.1

[56] References Cited

U.S. PATENT DOCUMENTS

| | | | |
|---|---|---|---|
| 3,373,922 | 3/1968 | Snellman et al. | 271/197 X |
| 3,622,150 | 11/1971 | Hayes | 271/188 X |
| 4,396,332 | 8/1983 | Schmidt et al. | 414/908 X |
| 4,938,657 | 7/1990 | Benson et al. | 271/188 X |
| 5,051,145 | 9/1991 | Lenhardt | 156/99 |
| 5,265,867 | 11/1993 | Magee | 271/188 X |
| 5,566,933 | 10/1996 | Salancy | 271/188 X |

*Primary Examiner*—Christopher P. Ellis
*Assistant Examiner*—Patrick Mackey
*Attorney, Agent, or Firm*—Rockey, Milnamow & Katz, Ltd.

[57] ABSTRACT

A sheet stacking apparatus includes laterally spaced, longitudinally arranged conveyors for supporting edge regions of a sheet, the conveyors driven to deliver the sheet horizontally to a stacking area. At the stacking area the conveyors are separated to drop the sheet onto a stack of sheets. During the delivery of the sheet to the stack, the mid-span of the sheet is supported from above to prevent sagging of the sheet. The mid-span is supported by at least one low pressure chamber which extends along the delivery path of the sheet. The low pressure chamber includes a plurality of suction compartments arranged in sequence, each suction compartment including a horizontally disposed air nozzle and an air outlet to create a horizontal "Fanno effect" air stream adjacent a top surface of the sheet to create suction within the low pressure chamber which holds the sheet in sliding contact against a bottom surface of the low pressure chamber. The bottom surface preferably includes a plurality of rollers to allow a reduced friction sliding/rolling of the sheet along the low pressure chamber.

16 Claims, 6 Drawing Sheets

SHEET STACKING APPARATUS

FIELD OF THE INVENTION

The present invention relates to an apparatus for receiving a plurality of sheets sequentially and creating a stack of the sheets. Particularly, the invention is directed to a sheet stacking apparatus which includes laterally spaced, longitudinally arranged conveyors for supporting longitudinal edges of sequentially fed sheets and which conveyors can be reciprocally moved apart to unload a sheet at a stacking location beneath the conveyors, and back together to receive a new sheet onto the conveyors. The apparatus includes a support mechanism, which operates on the principle of "Fanno effect" airflow for imparting a vertical supporting force on each of the sheets at approximately a mid-span of each sheet between the longitudinal edges thereof as the sheets proceed along the conveyors.

BACKGROUND OF THE INVENTION

In a sheet stacking apparatus, sheets are sequentially transported horizontally to a position above a stacking area and unloaded vertically to form a stack beneath the apparatus. Each sheet is transported horizontally by laterally spaced apart, longitudinally extending conveyors which support longitudinal edges of the sheet. Such a sheet stacking apparatus operates satisfactorily as long as the width of the sheet between the conveyors is not excessively wide to cause sagging of the sheet. Excessive sagging of the sheet can cause undue bending stress on the sheet or excessive friction or binding at the sheet edge along the conveyor rollers, or possibly cause the sheet to fall through the conveyors before reaching the stacking area. For a wide sheet, it is particularly difficult to support the mid-span of the sheet since any support beneath the sheet must be removed or relocated so as not to interfere with the stack, or the sheet unloading operation to form the stack.

It would be desirable to provide a stacking apparatus which was operable for both narrow sheets and wide sheets and which supported a mid-span of a wide sheet during transporting of the sheet to the stacking area. It would be desirable to provide a support mechanism which is not located such as to require a complex retraction to prevent interference with the forming of the stack. It would be desirable to provide a sheet stacking apparatus which could effectively stack wide sheets of thin gauge material without undue bending or sagging of the sheet.

SUMMARY OF THE INVENTION

The invention contemplates a stacking apparatus for stacking sequentially fed sheets which includes a central elongate low pressure chamber for supporting each sheet from above, at a mid-span of a sheet width during horizontal travel of the sheet, to a stacking location to form a stack. The apparatus includes laterally spaced, longitudinally arranged conveyors which are operable to be separated laterally, to drop each sheet of a sequence of sheets vertically onto the stack. The low pressure chamber includes a plurality of suction compartments arranged in sequence, each compartment including an air flow nozzle for directing pressurized air in a downstream direction to an exit aperture. The velocity of the air being discharged from the nozzles is sufficient to create a "Fanno effect" pressure differential between opposite sides (top and bottom) of the sheet so that the sheet is held by a vacuum effect against the suction compartments during travel of the sheet along the two conveyors.

The two conveyors are driven roller conveyors, each mounted on a pivotable carriage. The pivotable carriages can be actuated to tilt the roller conveyors downwardly and away from each other to increase the horizontal, lateral distance between the roller conveyors, to drop the sheet between the two conveyors onto a stacking area or onto the stack. The roller conveyors each include a series of driven support rollers along the length of each conveyor.

The pivotable carriages also carry edge guiding rollers which guide opposite longitudinal edges of each sheet and can be laterally positioned to accommodate sheets of varying widths and/or overhang distances over the series of support rollers of the two roller conveyors. Additionally, the carriages each carry a linear series of hold down rollers which are particularly adapted to hold down edge regions of each sheet onto the two series of conveyor rollers. The hold down rollers can be utilized when needed for wide sheets or not utilized when not needed for narrow sheets.

The low pressure chamber extends substantially an entire longitudinal length of the apparatus and is divided into two suction units which straddle a center line of the apparatus. Each suction unit includes two longitudinally extending rows of suction compartments which are staggered longitudinally, i.e., the two rows are non-aligned laterally. Each suction compartment includes a high pressure air nozzle oriented to direct flowing air in a longitudinal downstream direction of sheet progression, and an air outlet which discharges the flowing air from the suction compartment. The flow of air through each suction compartment creates suction for vertically supporting a mid-span of each sheet during its progression along the two conveyors.

Each suction unit includes a plurality of idler rollers arranged along opposite sides thereof which engage the sheet supported by the suction compartments. The idler rollers provide for a reduced friction, sliding movement of the sheets along the suction unit, and prevents contact between the compartment walls and the sheets to prevent scratching. The idler rollers extend down to at least the depth of the compartments, and preferably slightly more, such that the sheets smoothly roll along the underside of the suction units. Each sheet is closely fit to the suction compartments to create a slight vacuum (i.e., a pressure differential) to hold the sheet thereto. The suction units are deployed downward to an operative position by swing arms which each pivot about a horizontal, lateral axis to lower the units. The swing arms are pivoted by pneumatic actuators.

The suction units of the present invention provide an upward vertical force at approximately the mid-span of each sheet such that sagging, bowing or bending of the sheet is avoided. Because the sheet is supported from above, there is no apparatus which must be relocated or removed from below the sheet to facilitate stacking.

Numerous other advantages and features of the present invention will become readily apparent from the following detailed description of the invention and embodiments thereof, from the claims, and from the accompanying drawings in which the details are fully and completely disclosed as part of the specification.

DETAILED DESCRIPTION OF THE PREFERRED EMBODIMENTS

Figure 1:
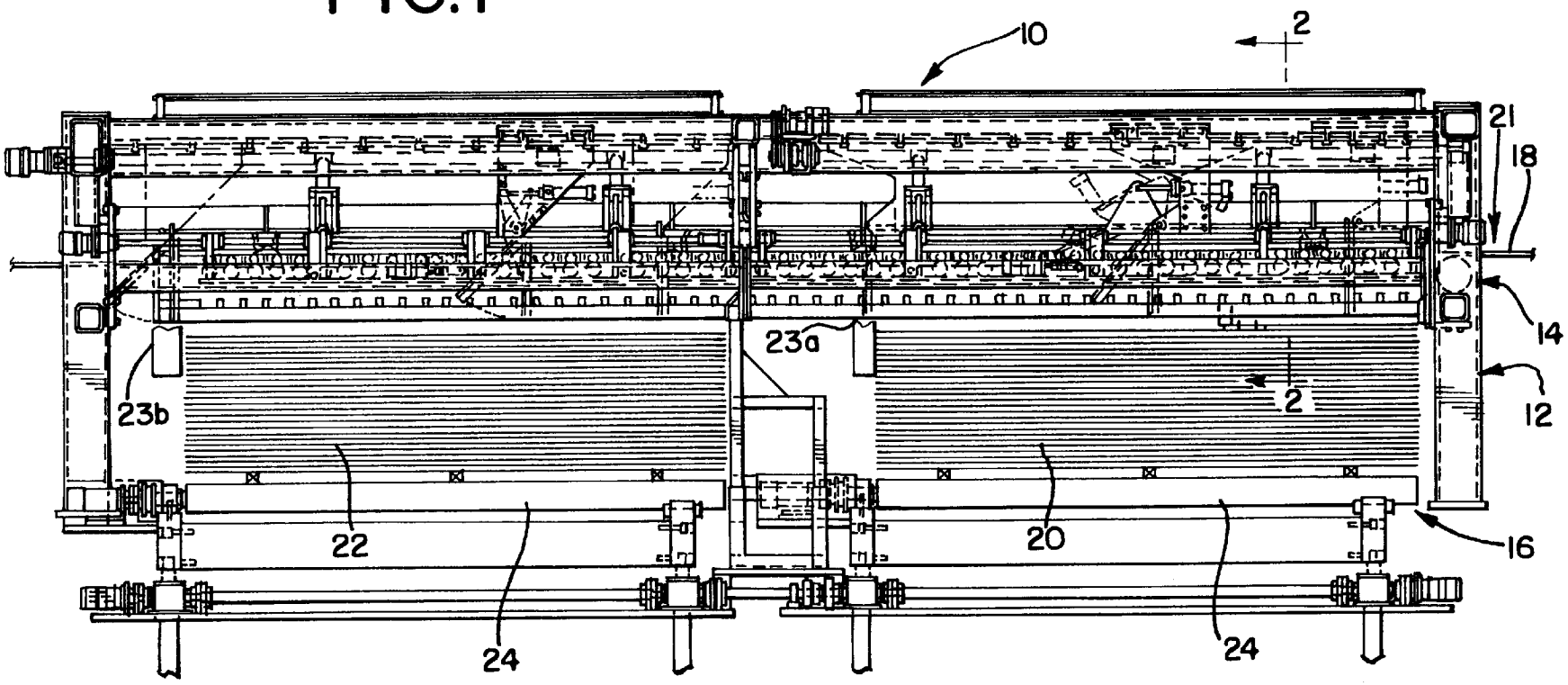
FIG. 1 is a fragmentary, longitudinal sectional view of the sheet stacking apparatus of the present invention.

While this invention is susceptible of embodiment in many different forms, there is shown in the drawings and will be described herein in detail, specific embodiments thereof with the understanding that the present disclosure is to be considered an exemplification of the principles of the invention to the specific embodiments illustrated.

FIG. 1 illustrates a sheet stacking apparatus 10 which includes a framework 12 which carries a horizontal conveyor assembly 14 and a stacking platform 16. Sheets, such as a sheet 18, are fed sequentially into the apparatus 10, such as by a conveyor (not shown) to be stacked onto the stacking platform 16. A first stack 20 is arranged closer to an inlet end 21 of the apparatus 10. A second stack 22 is arranged spaced from the first stack 20 in a downstream direction of sheet progression in the apparatus 10. The stacking platform 16 includes a plurality of stack supporting rollers 24 which facilitate removal of a completed stack from the apparatus 10.

To promote efficient operation, while the apparatus is operating and one of the stacks 20, 22 is being formed, the respective other stack 20, 22, already completed, can be removed from the apparatus 10. This ensures that the apparatus 10 need not be shut down to remove a stack, but can be continuously utilized to alternatively form a stack 20 or 22, and remove a stack 20 or 22. While the stack 20 is being formed, a spring loaded, retractable stop 23*a* (See FIG. 1) is deployed to physically define an edge of the stack 20. The stop 23*a* is spring loaded in a horizontal direction toward the sheet being dropped onto the stack, to allow some reverse horizontal movement or recoil of the stop upon impact by the sheet being dropped, to prevent the sheet from bouncing off the stop. The stop is thus resilient to more gently guide the dropping sheet to its orderly position on the stack. The stop 23*a* can be retracted by being pivoted upwardly when the second stack 22 is to be formed, to allow horizontal passage of the sheets. A second spring loaded stop 23*b* is also provided to physically define an edge of the second stack 22. The stop 23*b* need not be retractable if the second stack 22 is the furthest horizontal destination along the conveyor assembly 14 for sheets being stacked.

Figure 2:
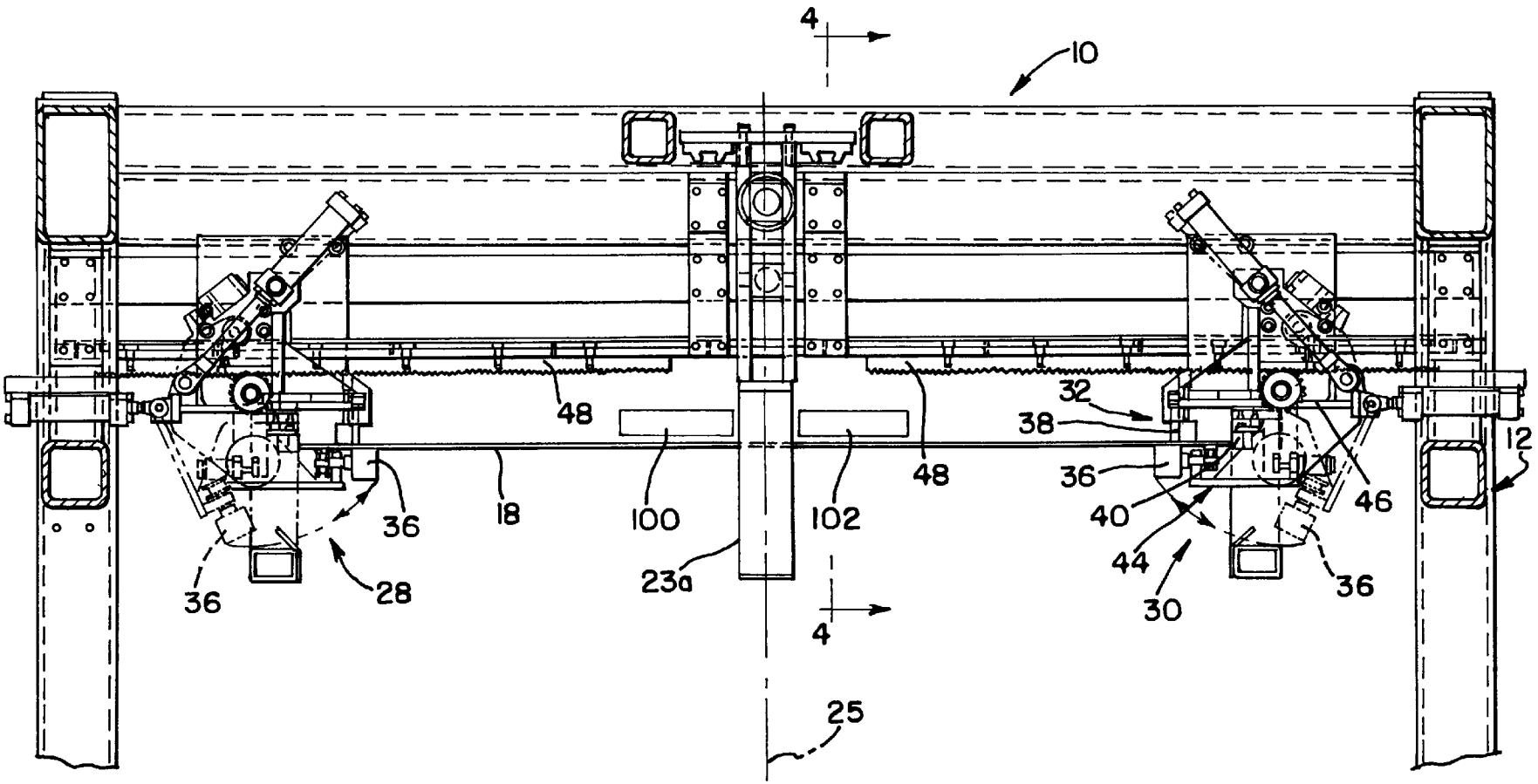
FIG. 2 is a fragmentary sectional view taken generally along line 2—2 of FIG. 1 with roller conveyors of the apparatus in a first lateral position.

FIG. 2 illustrates the apparatus 10 configured for stacking a wide sheet 18. The conveyor assembly 14 includes, on opposite lateral sides of a center line 25 of the apparatus 10, a first roller conveyor 28 and a second roller conveyor 30. The conveyors 28, 30, are substantially identical but arranged and constructed in mirror image fashion across the center line 25.

For purposes of simplicity, the second conveyor 30 will be described in detail with the understanding that the first conveyor 28 is constructed with similar components and in similar fashion.

Figure 7:
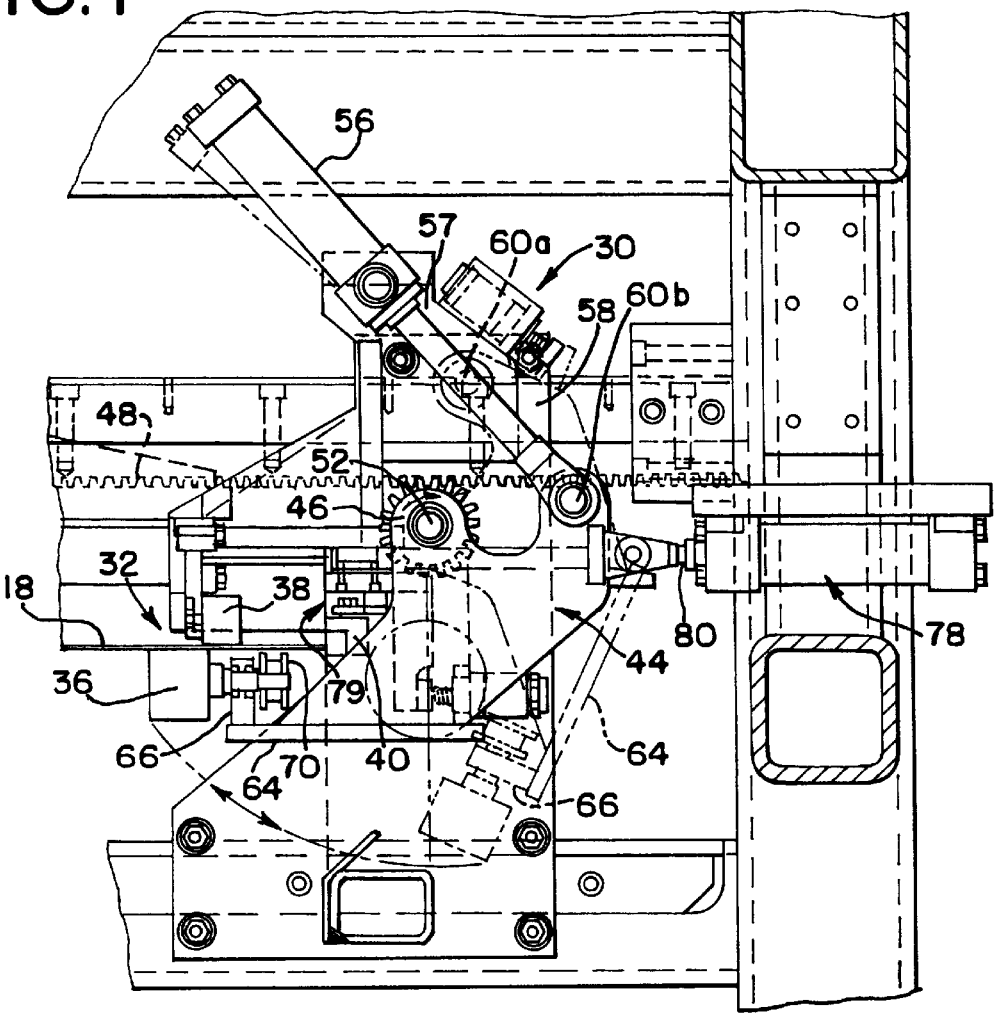
FIG. 7 is an enlarged, fragmentary sectional view taken from FIG. 2.

As illustrated in FIGS. 2 and 7, an edge region 32 of the sheet 18 is carried on a linear series of support rollers 36 which extend along a longitudinal delivery path of the apparatus 10. A portion of the edge region 32 is held down or clamped by a linear series of hold down rollers 38 which are set outwardly of the support rollers 36. A linear series of edge guiding rollers 40, rotatable about a vertical axis, are provided to laterally limit the longitudinal edge of the sheets.

The support rollers 36 are driven in rotation to transport the sheet 18 longitudinally along the delivery path. The hold down rollers 38 and the edge guiding rollers 40 assist in effectively preventing upwardly flexing of the edge regions 32 by captively restraining the edge portion. Restraining the edge regions 32 of the sheet 18 also acts to resist concave bowing of the sheet 18 at a mid-span thereof. The support rollers 36, the hold down rollers 38, and the edge guiding rollers 40 are all carried on a pivotable and movable carriage 44. The carriage 44 includes a traveling pinion 46 which is engaged to a stationary rack 48 of the framework 12 to allow the carriage 44 to be displaced inwardly or outwardly to accommodate sheets of varying widths. The traveling pinion is carried on a shaft which is driven by means (not shown) to position the conveyor 30 along the rack 48.

Figure 3:
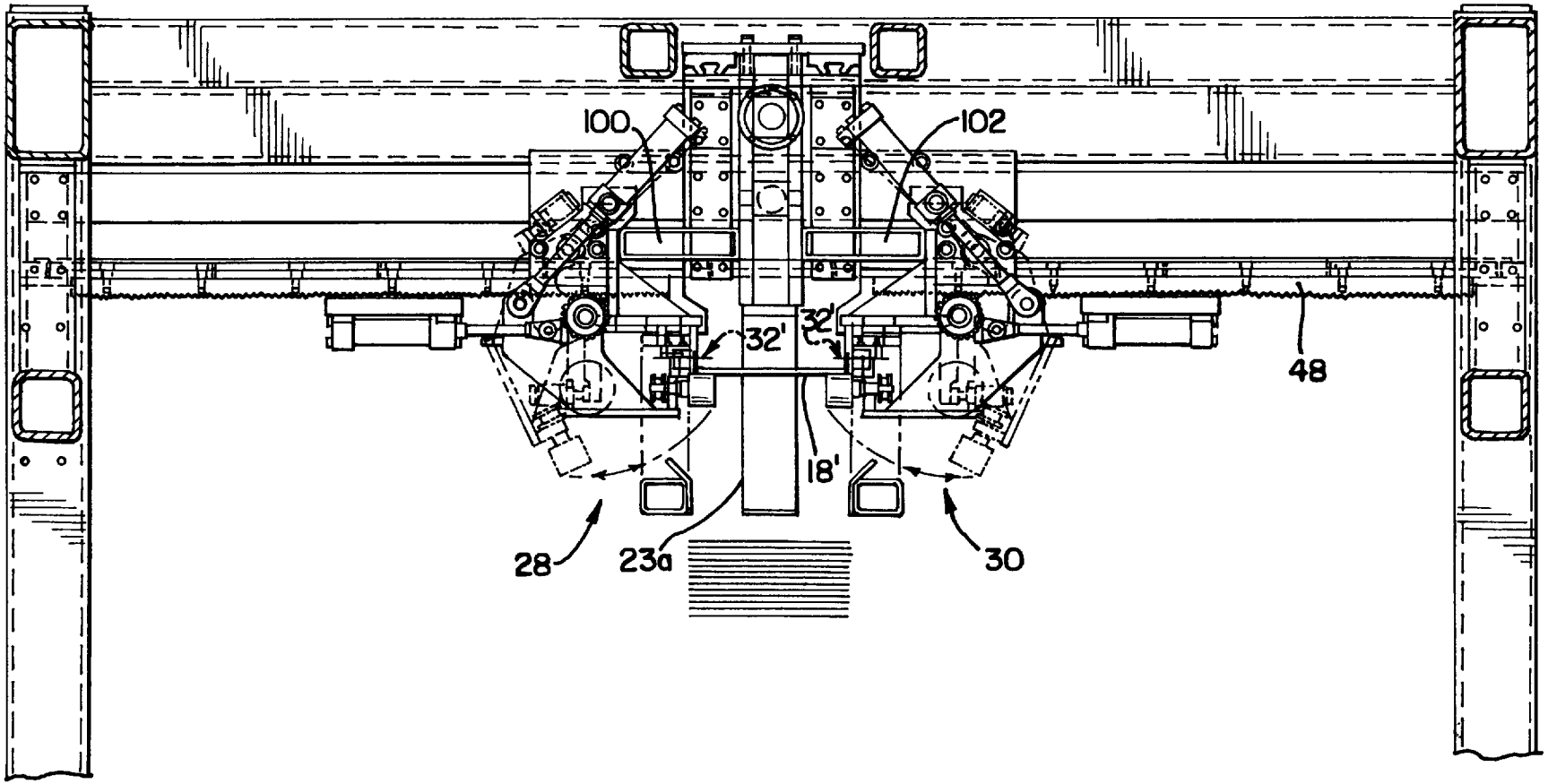
FIG. 3 is a fragmentary sectional view taken generally along line 2—2 of FIG. 1 with the roller conveyors in a second lateral position.
Figure 8:
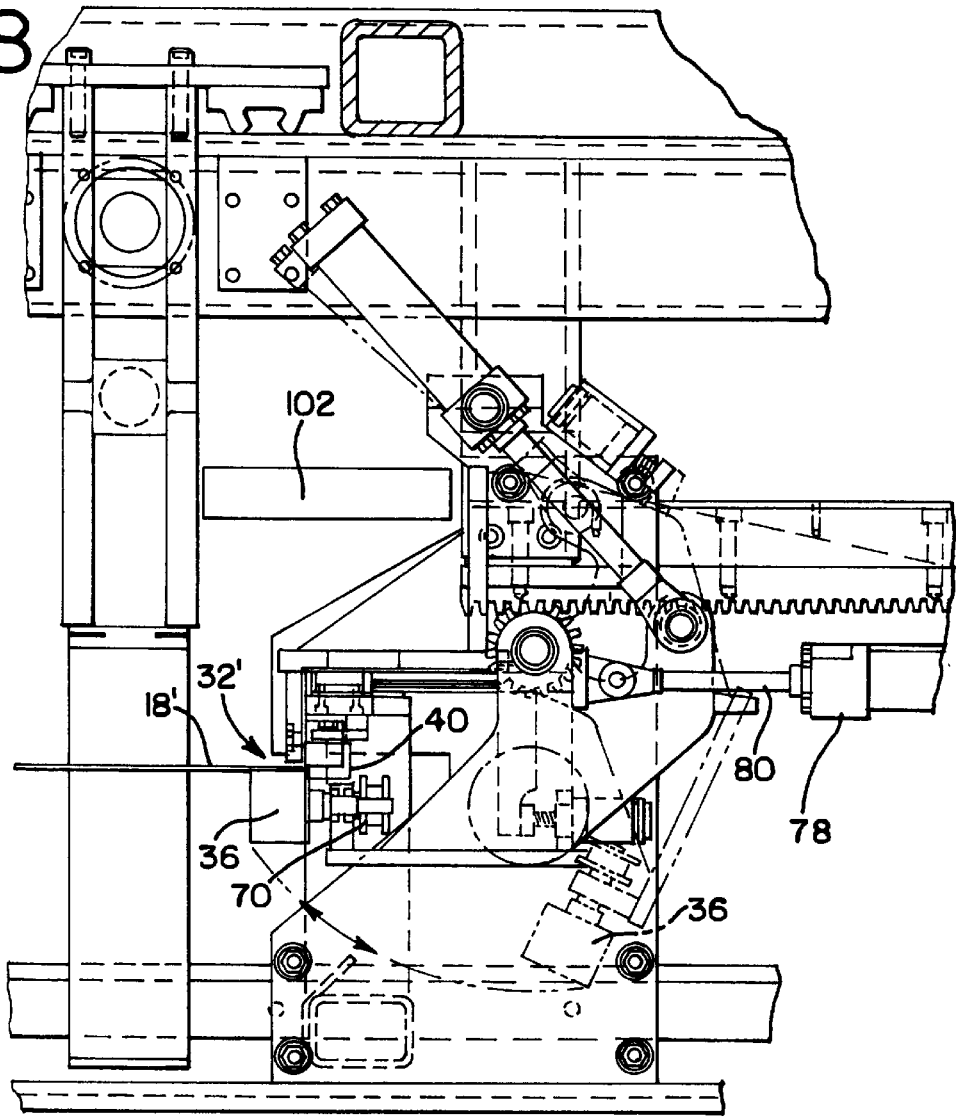
FIG. 8 is an enlarged fragmentary sectional view taken from FIG. 3.

As illustrated in FIGS. 3 and 8, the conveyors 28, 30 have been moved inwardly along the racks 48 to support a sheet 18' having a smaller width than the sheet 18 shown in FIG. 2.

FIGS. 7 and 8 illustrate the conveyor 30 in more detail. In these FIGURES, the conveyor 30 is shown solid in the sheet supporting position and is shown in phantom in the sheet release or stacking position. FIG. 7 illustrates the conveyor 30 in the position shown in FIG. 2 and FIG. 8 illustrates the conveyor 30 in the position shown in FIG. 3.

The carriage 44 is pivoted about a central axis 52 of the traveling pinion 46 by a plurality of actuators 56 spaced along the length of the conveyor 30. Each actuator 56 is connected via an actuator shaft 57 to a lever arm 58 of the carriage 44. The actuator shaft 57 is connected at a pivot point 60*a* to the lever arm 58. Attached to the carriage 44 is a swing plate 64 which carries a mounting plate 66. The mounting plate 66 rotatably carries the plurality of support rolls 36 in a linear sequence, extending the length of the delivery path. One or more of the support rollers 36 are driven in rotation via a sprocket or pulley 70 which in turn is driven by a chain or belt (not shown).

The actuator 56 is controlled to extend and retract the actuator shaft 57. When the actuator shaft 57 extends, the pivot point 60*a* moves to the location 60*b* and the carriage 44 pivots clockwise to turn the swing plate 64 and to swing the support rollers 36 to a horizontal position to support a new sheet 18. When the actuator 56 retracts the shaft 57, the rollers 36 are pivoted from beneath sheet 18 to release the sheet 18, which falls by gravity downwardly onto the stack of sheets (20 or 22).

An edge guide roller actuator 78 having an output shaft 80 is mechanically connected to the edge guide rollers 40 by an edge frame 79. Upon extension of the shaft 80 by the actuator 78, the edge guide rollers 40 proceed to the left (as shown in FIGS. 3 and 8) for adjustably locating the rollers 40 against edge 32' of the more narrow sheet 18'. The hold-down rollers 38 are not used for the relatively narrow sheet 18'. The edge guide rollers and the hold-down rollers are offset, or staggered longitudinally, so as not to mechanically interfere with each other when moved into this position.

Returning to FIG. 2, above the sheet 18, on opposite sides of the center line 25, and close thereto, are first and second suction units 100, 102 respectively. The suction units 100, 102 are lowered to operative position to be in contact with the sheet 18. The suction units are shown schematically as blocks in FIG. 2 and are explained in more detail in FIGS. 4 through 6.

FIG. 3 illustrates the first and second suction units 100, 102 in a raised position above the more narrow sheet 18'. The suction units 100, 102 are inactive during the stacking of the narrow sheets.

Figure 4:
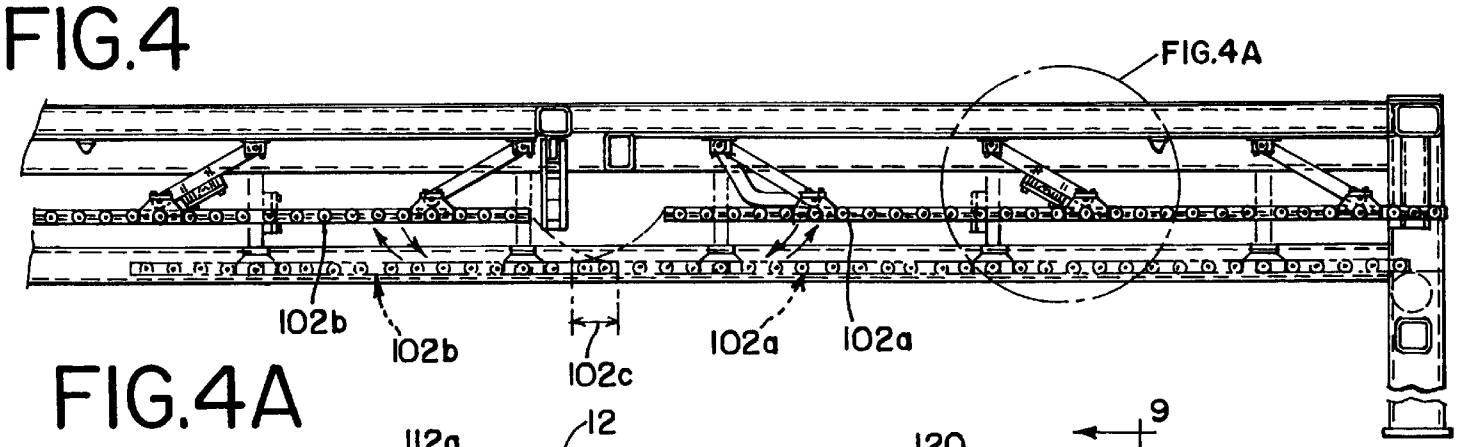
FIG. 4 is a fragmentary sectional view of an overhead sheet support system of the present apparatus taken from FIG. 1.

FIG. 4 illustrates the suction unit 102 to include two independently movable sections, such as the sections 102*a*, 102*b* illustrated. The suction unit 102 is pivotable to swing downwardly into an operative position (shown dashed) or upwardly into a retracted, inoperative position (corresponding to FIG. 3). The ends of the sections 102*a*–102*b* are offset or staggered to mesh and overlap longitudinally in the region 102*c*. The suction unit 100 has sections (not shown) which operate identically to that shown for the sections 102*a*, 102*b*.

Figure 4A:
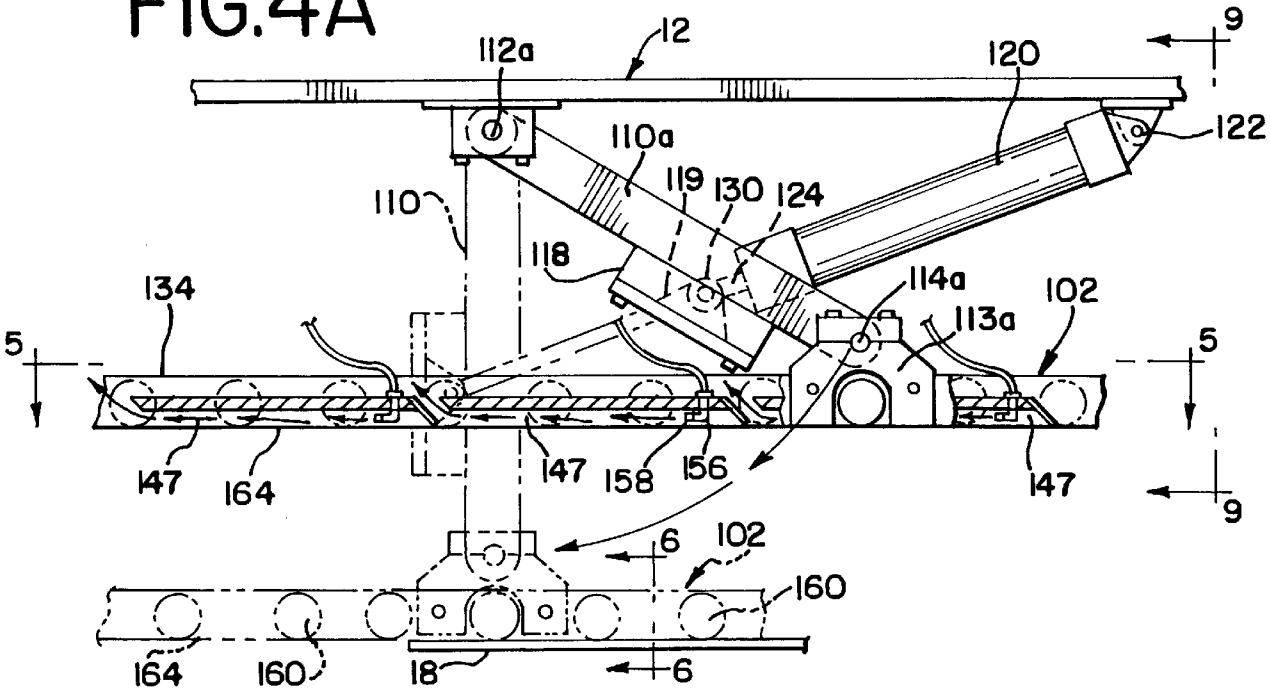
FIG. 4A is a fragmentary, enlarged sectional view taken from FIG. 4.
Figure 9:
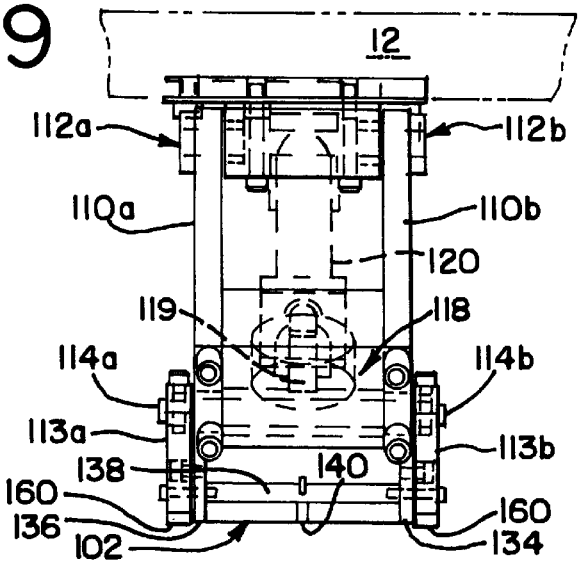
FIG. 9 is a side view of the sheet stacking apparatus.

As illustrated in FIGS. 4A and 9, the suction unit 102, which is substantially identical to the suction unit 100, is moved into position on a top surface of the sheet 18 by a pair of parallel swing arms 110*a*, 110*b*, which are pivotally connected at base ends 112*a*, 112*b* to the framework 12. The swing arms 110*a*, 110*b* are pivotally connected at distal ends to lugs 113*a*, 113*b* at pivot points 114*a*, 114*b*. The lugs 113*a*, 113*b* are connected to opposite lateral sides of the unit 102 as shown in FIGS. 5 and 9.

Centrally located between the pivot points 112*a*, 112*b* and 114*a*, 114*b* respectively is a cross bracket 118 having a triangular attachment bracket 119. The cross bracket 118 is of a bolted construction and has a substantial U-shape. The cross bracket 118 is connected between the pair of swing arms 110*a*, 110*b*. An actuator 120 which is pivotally connected at a base end 122 to the framework 12, has an output shaft 124 which is connected to the bracket 119 at a pivot point 130. Extension of the output shaft 124 turns the pair of swing arms 110*a*, 110*b* together about the pivot points 112*a*, 112*b* and lowers the suction unit 102 onto the sheet 18. Retraction of the output shaft 124 by the actuator 120 raises the suction unit 102.

Figure 5:
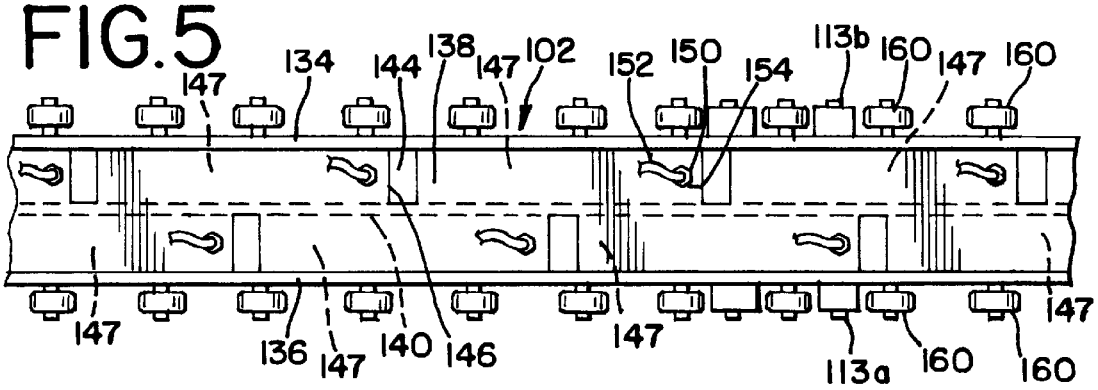
FIG. 5 is a fragmentary, sectional view taken generally along line 5—5 of FIG. 4A.
Figure 6:
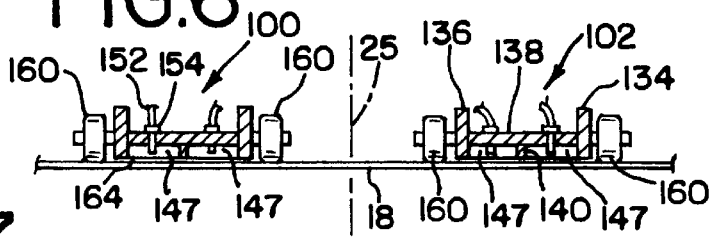
FIG. 6 is a fragmentary, sectional view taken generally along line 6—6 of FIG. 4A.

The suction unit 102 as shown in FIGS. 4–6 includes sidewalls 134, 136 connected by a horizontal, top wall 138. The horizontal, top wall 138 is divided longitudinally on a bottom side thereof by a vertical divider wall 140. Arranged intermittently along the horizontal, top wall 138, and staggered across the divider wall 140, are inclined end walls 144 each of which extend downwardly from a position adjacent to a rectangular opening 146. A plurality of low pressure compartments or suction compartments 147 are thus defined between one of the side walls 134, 136, the divider wall 140 and adjacent end walls 144. The openings 146 are open to atmosphere above the horizontal, top wall 138.

Within each suction compartment at a longitudinal end opposite a respective rectangular opening 146, is located an air inlet 150. The air inlet 150 includes an air delivery hose 152 connected to a hose fitting 154 which penetrates the horizontal wall 138 and connects to an L-shaped fitting 156. The air delivery hose is connected to a source of pressurized air (not shown). The L-shaped fitting 156 mounts an air nozzle 158 which has an outlet directed toward the respective rectangular opening 146. Thus, pressurized air delivered to each air nozzle 158, via a respective delivery hose 152, proceeds horizontally along a top surface of the sheet 18 and toward the end wall 144, which directs the air upwardly through the rectangular opening 146.

High velocity air flows between the nozzles 158 and the openings 146 according to flow conditions which are similar to flow conditions known as "Fanno flow."

Fanno flow is a flow in which a compressible gas flows through a channel of constant cross-sectional area and the wall friction of the flow area acts to reduce the static pressure of the flow. For subsonic flow, the gas pressure drops along the length of the channel because the density of the flowing gas decreases, which causes the velocity of the gas to increase. The increase in velocity in turn causes additional pressure drop along the channel. The pressure drop along the channel reduces the static pressure within the channel to below atmospheric pressure.

According to the invention, the channel is suction compartments 147, which are substantially closed by the sheet 18, form the Fanno flow channels. Thus, each sheet is supported by suction force caused by the air pressure drop in the suction compartment above the sheet.

As illustrated in FIGS. 5 and 6, a sequence of idler rollers 160 are rotably mounted on outside surfaces of the sidewalls 134, 136. The idler rollers are located and sized to extend radially very slightly below a bottom surface 164 of the sidewalls 134, 136 such that the idler rollers 160 are pressed by the sheets under influence of suction from the suction compartment. Although the sheets are very close to the bottom surface 164 of the side walls 134, 136, the sheets press the rollers 160 rather than the bottom surface of the side walls 134, 136. This creates a reduced friction sliding between the sheet and the suction compartments and also prevents scratching of the sheets by the walls of the suction compartments.

The suction force exerted by the suction units 100, 102 can be designed to be less than the weight of the sheet so that removal of sheet support by the conveyors 28, 30 causes the sheet to fall free of the suction units onto the stack below.

From the foregoing, it will be observed that numerous variations and modifications may be effected without departing from the spirit and scope of the invention. It is to be understood that no limitations with respect to the specific apparatus illustrated herein is intended or should be inferred. It is, of course, intended to cover by the appended claims all such modifications as fall within the scope of the claims.

What is claimed is:

1. An apparatus for transporting a sheet, comprising:

a first conveyor arranged to support a first edge region of said sheet;

a second conveyor arranged to support a second edge region of said sheet, said first and second conveyors arranged in parallel along a delivery path of said apparatus;

at least one of said first and second conveyors being driven to transport said sheet along said delivery path;

a low pressure chamber extending along said delivery path of said sheet, said low pressure chamber having a surface in moving contact with said sheet, and said sheet held to said low pressure chamber by differential air pressure acting on top and bottom surfaces of said sheet, wherein said low pressure chamber includes a plurality of suction compartments each having an air inlet and an air outlet and arranged in sequence along said delivery path and wherein said low pressure compartment is sized, and said air pressure into said air inlet is regulated, such that air flowing between said air inlet and said air outlet creates a Fanno flow effect against the top surface of said sheet.

2. The apparatus according to claim 1 wherein said plurality of suction compartments each define an air path between said aid inlet and said air outlet, said air path being substantially parallel to a surface of said sheet, each suction compartment having a top wall opposing side walls, and opposing end walls which together define an open bottom substantially closed by said sheet.

3. The apparatus according to claim 2 wherein said low pressure chamber comprises two rows of said suction compartments arranged along said delivery path, said two rows being staggered along said delivery path such that end walls of said suction compartments are non-aligned in a transverse direction to said delivery path.

4. The apparatus according to claim 3 wherein said suction compartments are arranged end to end along said delivery path without a space between suction compartments.

5. The apparatus according to claim 1 wherein said first and second conveyors are tiltable away from each other to allow said sheet to drop therebetween.

6. The apparatus according to claim 1 wherein said first and second conveyors each comprise a series of driven rollers in rolling contact with said sheet.

7. The apparatus according to claim 1 wherein said low pressure chamber is adjustable vertically to be placed in close proximity to the sheet.

8. The apparatus according to claim 1 wherein said first and second conveyors each comprise edge guiding rollers, rotatable about vertical axes, to guide movement of the sheets along the delivery path.

9. The apparatus according to claim 1 wherein said first and second conveyors each comprise hold down rollers for holding the sheets down onto driven portions of said first and second conveyors at said first and second edge regions.

10. The apparatus according to claim 1 wherein each of said first and second conveyors include a sequence of driven support rollers, said first and second conveyor being selectively tiltable downwardly to drop said sheet therebetween.

11. The apparatus according to claim 10 wherein each of said first and second conveyors include hold down rollers for holding said edge regions down onto said support rollers.

12. A sheet stacking apparatus, comprising:

a first conveyor having a series of first support rollers arranged along a longitudinal direction of the apparatus, and arranged to support a first edge region of said sheet;

a second conveyor having a series of second support rollers arranged along the longitudinal direction of the apparatus, and arranged to support a second edge region of said sheet, said first and second conveyors arranged in parallel along the longitudinal direction of said apparatus;

said first and second support rollers of said first and second conveyors being driven to transport said sheet along said longitudinal direction;

a low pressure chamber extending along said longitudinal direction, said low pressure being substantially in sliding contact with said sheet, said sheet substantially closing a portion of said low pressure chamber and held to said low pressure chamber by differential pressure acting on top and bottom surfaces of the sheet;

wherein said first and second conveyors deliver said sheet in the longitudinal direction to a stacking area;

said first and second conveyors being displaceable to allow said sheet to fall into said stacking area, wherein said low pressure chamber comprises a plurality of suction compartments each having a pressurized air inlet and an air outlet, and defining an air path between said aid inlet and said air outlet, said air path being substantially parallel to the top surface of said sheet, each said suction compartment having a top wall, opposing side walls, and opposing end walls which together define an open bottom closed by said sheet.

13. The apparatus according to claim 12 wherein said suction chamber comprises two rows of said suction compartments arranged along said longitudinal direction, said two rows being staggered along said longitudinal direction such that end walls of said suction compartments do not align in a transverse direction to said longitudinal direction.

14. The apparatus according to claim 12 wherein said suction compartments are arranged end to end along said longitudinal direction without a space between suction compartments.

15. The apparatus according to claim 12 wherein said first and second conveyors are tiltable away from each other to allow said sheet to drop therebetween.

16. A sheet stacking apparatus, comprising:

a first conveyor having a series of first support rollers arranged along a longitudinal direction of the apparatus, and arranged to support a first edge region of said sheet;

a second conveyor having a series of second support rollers arranged along the longitudinal direction of the apparatus, and arranged to support a second edge region of said sheet, said first and second conveyors arranged in parallel along the longitudinal direction of said apparatus;

said first and second support rollers of said first and second conveyors being driven to transport said sheet along said longitudinal direction;

a low pressure chamber extending along said longitudinal direction, said low pressure being substantially in sliding contact with said sheet, said sheet substantially closing a portion of said low pressure chamber and held to said low pressure chamber by differential pressure acting on top and bottom surfaces of the sheet;

wherein said first and second conveyors deliver said sheet in the longitudinal direction to a stacking area;

said first and second conveyors being displaceable to allow said sheet to fall into said stacking area, wherein said differential pressure is created by air flowing at high velocity within said low pressure chamber, wherein said low pressure chamber includes a plurality of suction compartments each having an air inlet and an air outlet, and wherein each said compartment is sized, and air pressure into said air inlet is regulated, such that air flowing between said inlet and said outlet creates a Fanno flow effect against the top surface of said sheet.

* * * * *